United States Patent [19]

Pifer

[11] 4,213,309

[45] Jul. 22, 1980

[54] RECREATIONAL VEHICLE MULTI-LEVEL COOLER

[76] Inventor: William J. Pifer, 8100 Denwood, Apt. 106, Sterling Heights, Mich. 48077

[21] Appl. No.: 960,239

[22] Filed: Nov. 13, 1978

[51] Int. Cl.[2] ..... F25B 25/00

[52] U.S. Cl. ..... 62/332; 62/337; 62/457

[58] Field of Search ..... 62/332, 337, 457, 458, 62/459, 460, 464

[56] References Cited

U.S. PATENT DOCUMENTS

| | | | |
|---|---|---|---|
| 1,209,627 | 12/1916 | Saunders | 62/457 |
| 1,447,733 | 3/1923 | Shulde | 62/464 |
| 2,207,333 | 7/1940 | Perham et al. | 62/332 |
| 2,527,572 | 10/1950 | Pownall | 62/332 |
| 3,505,830 | 4/1970 | Koerner | 62/337 |
| 3,605,431 | 9/1971 | Carson | 62/457 |
| 3,971,231 | 7/1976 | Derry | 62/457 |

*Primary Examiner*—Ronald C. Capossela
*Attorney, Agent, or Firm*—Beaman & Beaman

[57] ABSTRACT

The invention pertains to a cooler particularly suitable for use with recreational vehicles, such as tent trailers, and consists of a receptacle formed of a homogeneous sheet of synthetic plastic material wherein a portion of the receptacle includes a first bottom portion located at a vertical orientation higher than the vertical orientation of a second bottom receptacle portion wherein the cooler bottom is defined at different elevations. A partition separates the cooler multi-levels and consists of a wire grill slidably received within grooves defined in the receptacle side walls. Block ice may be located within the upper cooler level and a refrigeration system evaporator may also be placed therein, and the cooler construction permits a relatively large size cooler capacity in a concise configuration particularly adaptable to the vehicle interior configuration.

8 Claims, 3 Drawing Figures

RECREATIONAL VEHICLE MULTI-LEVEL COOLER

BACKGROUND OF THE INVENTION

The invention pertains to insulated coolers for food and the like for use with recreational vehicles, and particularly pertains to the construction of the cooler receptacle body.

Portable food coolers conventionally include a chamber surrounded by thermal insulation having an access opening or cover, and such coolers presently take many shapes and configurations, the thermal insulation consisting of fiberglas, vacuum chambers or foam layers usually utilizing closed cells formed of a urethane material. It is known to build coolers of such conventional construction into the counters and cabinets of recreational vehicles, such coolers employing block ice, or refrigeration systems, to maintain the cooler at a food preserving temperature. However, with tent trailers and similar low vertical profile recreational vehicles such built-in coolers must necessarily be limited in vertical height, and due to vehicle configurations, such as wheel wells, the vehicle interior space for built-in coolers is usually limited.

Refrigerators and coolers are known wherein the cooler includes separate compartments for ice and the food being preserved, and multi-layer and compartmented refrigerators and coolers are shown in U.S. Pat. Nos. 1,447,733; 3,505,830 and 3,605,431. However, multi-level coolers have not been previously utilized in recreational vehicles, nor have the advantages of such coolers been appreciated when employed in recreational vehicles.

It is an object of the invention to provide a cooler for recreational vehicle use wherein the cooler incorporates a multi-level construction permitting separation of block ice and/or an evaporator from the food being preserved.

A further object of the invention is to provide a recreational vehicle cooler utilizing a multi-level construction wherein a partition separating the cooler levels is employed to prevent block ice from resting upon the refrigerated food and interfering with access thereto.

An additional object of the invention is to provide a compartmented cooler for recreational vehicle use wherein a refrigerator evaporator and block ice may simultaneously occupy a compartment separate from the food being cooled.

A further object of the invention is to provide a multi-level cooler wherein the receptacle thereof is formed of a homogeneous sheet of synthetic plastic material, and wherein the material defines grooves for receiving a wire grid partition to separate cooler compartments.

In the practice of the invention a homogeneous synthetic plastic material is utilized to form a receptacle having one floor portion at a significantly higher vertical elevation than the other floor portion. The higher floor portion is utilized to support block ice and/or define a chamber in which a refrigeration circuit evaporator is located, and a partition separates the upper and lower cooler levels to prevent intermixing of the block ice with the food being cooled. As the food is located at a vertical elevation below the ice, the food is exposed to the lowest temperatures within the cooler, and the construction of a cooler in accord with the invention permits efficient cooling.

The cooler construction is such that clearance is provided below the receptacle's upper bottom portion, and such clearance permits the cooler to be mounted in low profile recreational vehicles wherein a wheel well may be located in the clearance provided by the cooler construction. Also, this construction permits a compressor or other refrigeration circuit components to be located exteriorally of the cooler chamber without adding to the overall plan dimensions of the cooler.

A wire grid partition exists between the cooler compartments, and this petition is mounted within spaced parallel grooves defined within the receptacle side walls, such grooves being formed by elongated ridges homogeneously defined by the receptacle material.

BRIEF DESCRIPTION OF THE DRAWINGS

The aforementioned objects and advantages of the invention will be apparent from the following description and accompaning drawings wherein.

DESCRIPTION OF THE PREFERRED EMBODIMENT

Figure 1:
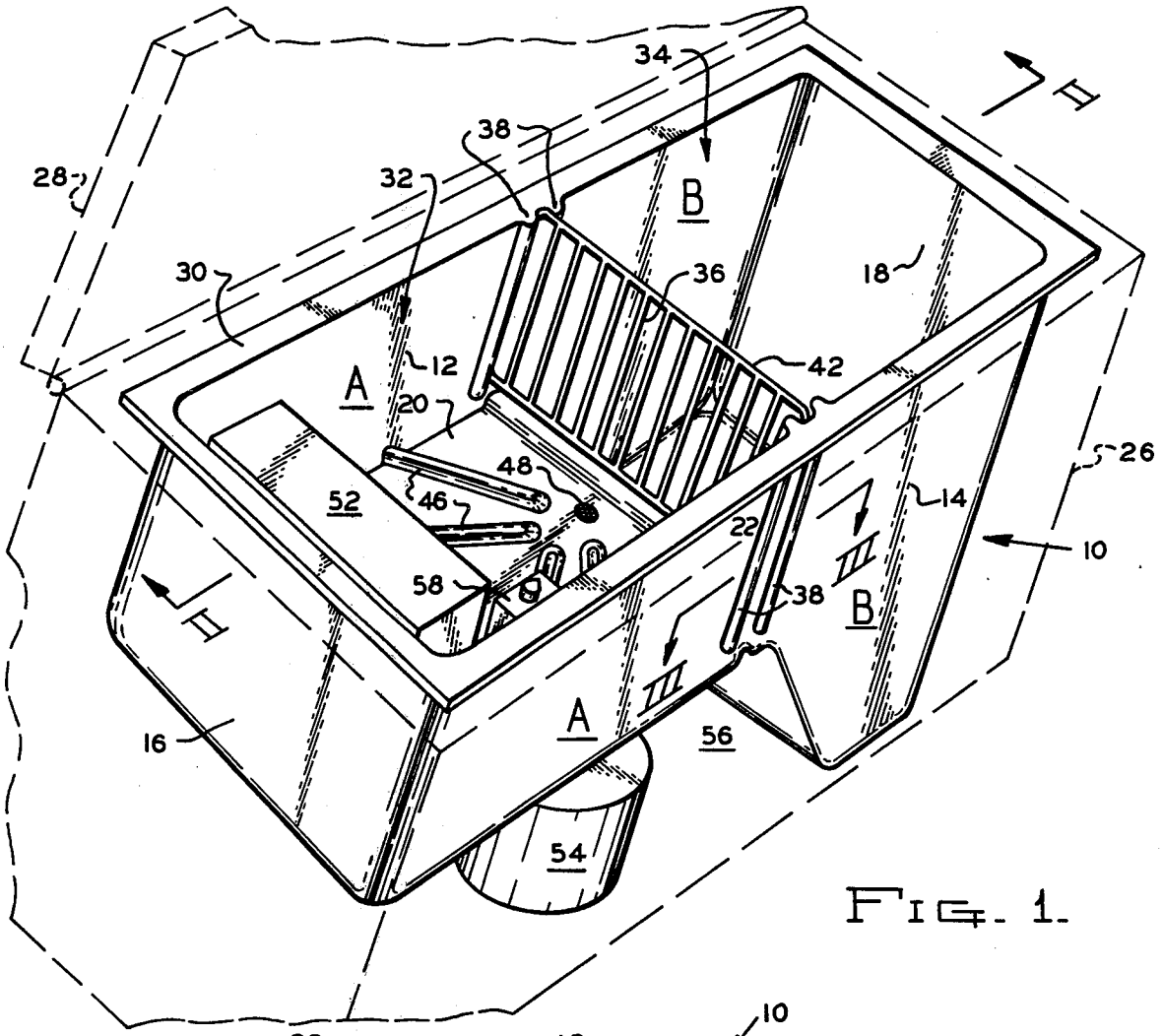
FIG. 1 is a perspective view of a cooler constructed in accord with the invention.
Figure 2:
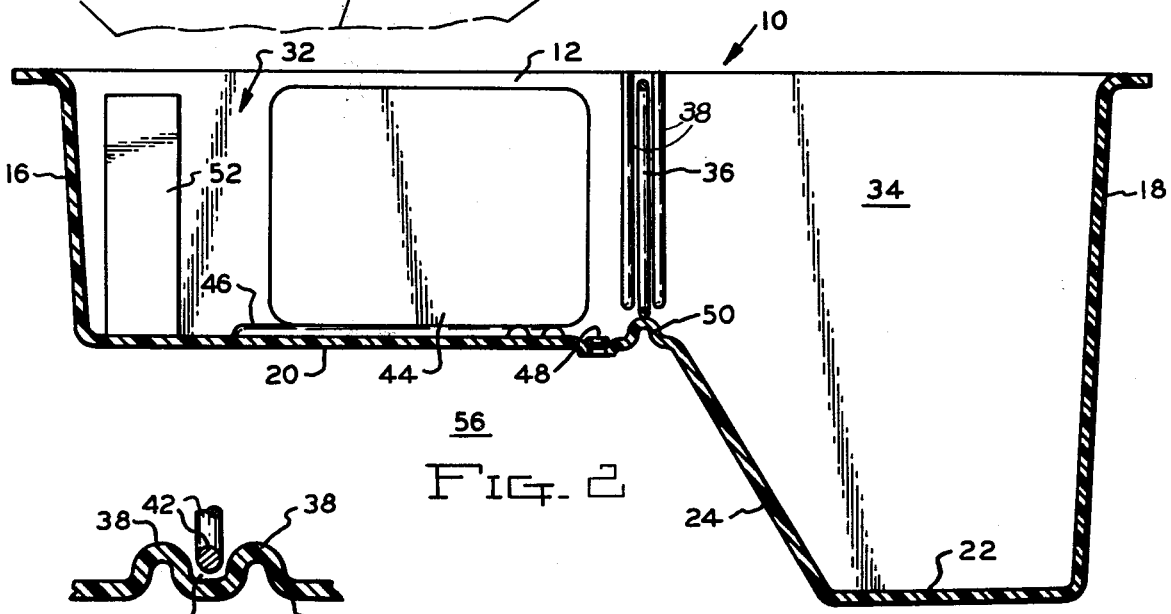
FIG. 2 is an elevational sectional view of a cooler receptacle constructed in accord with the invention, taken along Section II—II of FIG. 1, the refrigerator components exterior of the receptacle not being shown

The general configuration and relationships of the components of a cooler in accord with the invention will be appreciated from FIGS. 1 and 2. The cooler consists of a receptacle 10 open at its upper end and defined by the planar side walls 12 and 14, end wall 16 and 18, and bottom portions 20 and 22. An oblique bottom panel 24 extends between the central region of the cooler and the bottom portion 22. The receptacle 10 is preferably formed of a synthetic plastic material such as polystyrene, and may be formed by a molding procedure, such as vacuum molding. The receptacle 10 is mounted in a thermally insulated jacket generally indicated at 26. The jacket 26 may comprise a freestanding box wherein insulation is located between the box and the receptacle walls and bottom, or the jacket may constitute a recreational vehicle cabinet or counter as to be "built in". The jacket includes a pivoted insulated cover 28 which closes the receptacle open top, and will usually employ resilient seals to form an air tight relationship with the receptacle flange 30 extending from the side and end walls. This chest type construction minimizes the loss of cool air during access to the cooler.

Each of the side walls 12 and 14 includes a wall portion A which is of a lesser dimension than the side wall portions B which are disposed above the bottom portion 22. Thus, the bottom portions 20 and 22 will be located at different vertical elevations resulting in a multi-level cooler. The upper level chamber 32 is normally utilized to house the refrigeration circuit evaporator and block ice, while the chamber 34 of the cooler above the bottom portion 22 will house the food being cooled. The two chambers defined within the cooler are separated by a wire grill partition 36.

Figure 3:
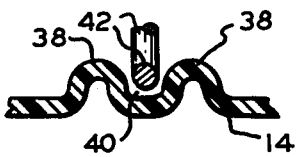
FIG. 3 is an elevational, detail, enlarged cross sectional view of the partition supporting grooves as taken along Section III—III of FIG. 1.

The partition 36 is supported within the cooler by means of parallel ribs or ridges 38 homogeneously defined from the receptacle side wall material as will be appreciated from FIG. 3, and the parallel spacing of the ridges defines a groove 40 which receives the frame 42 of the partition 36 wherein the partition may be readily inserted or removed from the opposed grooves 40.

As block ice 44 will be located upon the bottom portion 20 supporting and reinforcing ribs 46 are homogeneously defined in the bottom material thereof, and a drain opening 48 is formed within the bottom portion 20 for permitting the melted ice to drain from the cooler. The cooler also includes a dam 50 extending between the side walls 12 and 14, FIG. 2, to prevent water within the upper level from flowing into the lower level and upon the food.

The aforedescribed cooler construction permits a refrigeration circuit evaporator 52 to be mounted upon the bottom portion 20 adjacent the end wall 16, and the refrigerator compressor 54 and condenser, not shown, may be located in the clearance 56 provided below the bottom 20. The controls for the refrigeration circuit may be located within the cooler at 58, and as will be appreciated from FIGS. 1 and 2, the area of the bottom portion 20 is sufficient that the block ice 44 can be located between the evaporator and the partition 36 when the cooler is being utilized at a location where electricity is not available.

The existence of the partition 36 assures the maintaining of the ice block 44 upon bottom portion 20 and the ice block cannot fall upon the food to interfere with access thereof, or damage food containers. However, as the partition may be readily removed cleaning is facilitated and if the user desires to place a very large object, such as a watermelon, within the cooler, removal of the partition will permit such usage.

The construction of the cooler permits a recreational vehicle of low profile, such as a tent or folding trailer, to include a high capacity cooler, and if the refrigeration components are not employed, the clearance 56 permits space for the trailer wheel well thereby increasing the options of cooler location within the trailer interior.

Recreational vehicle coolers of the disclosed type may have a capacity of four and one-half cubic feet utilizing two inches of urethane foam insulation. Thus, larger capacities of coolers may be used than are normally available having greater resistance to heat transfer, and with a cooler of this type the necessity to maintain the cooler level is not important, as is the case with many recreational vehicle refrigerators.

It is appreciated that various modifications to the inventive concepts may be apparent to those skilled in the art without departing from the spirit and scope of the invention.

I claim:

1. A cooler particularly suitable for use with recreational vehicles comprising, in combination, a receptacle defined by first and second end walls, first and second side walls, a first bottom disposed adjacent said first end wall and a second bottom disposed adjacent said second end wall, said side walls each including a first portion intersecting said first end wall and said first bottom, a second portion intersecting said second end wall and said second bottom and a central region disposed intermediate said first and second bottoms, the vertical dimension of said first wall portions and said first end wall being less than the vertical dimension of said second wall portions and said second end wall whereby said first bottom is located at a higher vertical elevation than said second bottom, a drain opening defined in said first bottom, a plurality of block ice supporting ridges homogeneously defined in said first bottom extending upwardly from the general configuration of said first bottom, partition supporting means defined in said side walls at said central region thereof, and a vertically disposed partition supported within said partition supporting means.

2. In a cooler as in claim 1, said partition supporting means comprising an elongated vertically extending groove defined with said central region of each of said side walls, said partition being of a generally planar configuration and slidably received within said grooves.

3. In a cooler as in claim 2, said receptacle being formed of a homogeneous sheet of synthetic plastic material.

4. In a cooler as in claim 3, a refrigeration system evaporator located within said receptacle above said first bottom, and a refrigeration compressor operatively connected to said evaporator.

5. In a cooler as in claim 2, said partition supporting grooves being defined in each side wall by a pair of spaced parallel ribs formed of the material of the associated side wall and extending toward the opposite side wall.

6. In a cooler as in claim 5, said partition comprising a welded wire grill having a frame member slidably received within said side wall grooves.

7. A cooler for recreational vehicles comprising, in combination, a receptacle having an open top and defined by first and second end walls, first and second side walls, a first bottom member adjacent said first end wall and a second bottom member adjacent said second end wall located at a vertical elevation lower than said first bottom member, a refrigeration circuit heat exchanger within said receptacle adjacent said first bottom member operatively connected to refrigeration circuit apparatus exterior of said receptacle, a bulk ice receiving area defined on said first bottom member adjacent said heat exchanger, and a drain opening defined in said first bottom member.

8. In a cooler as in claim 7, a partition defined in said receptacle intermediate said first and second bottom members extending between said side walls, said bulk ice receiving area being defined intermediate said heat exchanger and said partition.

* * * * *